United States Patent [19]

Mihara et al.

[11] 4,286,044

[45] Aug. 25, 1981

[54] SILVER HALIDE PHOTOGRAPHIC MATERIALS

[75] Inventors: Yuji Mihara; Haruo Takei; Noriyuki Inoue; Tadashi Ikeda; Kenichi Kuwabara, all of Ashigara, Japan

[73] Assignee: Fuji Photo Film Co., Ltd., Minami-ashigara, Japan

[21] Appl. No.: 176,442

[22] Filed: Aug. 8, 1980

[30] Foreign Application Priority Data

Aug. 8, 1979 [JP] Japan ..... 54/100858

[51] Int. Cl.[3] ..... G03C 1/08

[52] U.S. Cl. ..... 430/264; 430/265; 430/266; 430/267; 430/268; 430/572; 430/602

[58] Field of Search ..... 430/264, 265, 267, 572, 430/577, 592, 266, 602, 268

[56] References Cited

U.S. PATENT DOCUMENTS

| | | | |
|---|---|---|---|
| 3,703,377 | 11/1972 | Sakazume et al. | 430/592 |
| 4,014,702 | 3/1977 | Hinata et al. | 430/572 |
| 4,047,964 | 9/1977 | Hinata et al. | 430/577 |
| 4,057,430 | 11/1977 | Sato et al. | 430/592 |

*Primary Examiner*—J. Travis Brown

*Attorney, Agent, or Firm*—Sughrue, Mion, Zinn, Macpeak and Seas

[57] ABSTRACT

A lith-type silver halide photographic material having high sensitivity and providing good dot quality images comprising a support having coated thereon a silver halide emulsion containing a sensitizing dye of dimethine merocyanine type represented by formula (I) and a sensitizing dye represented by formula (II):

(I)

wherein $R_1$ represents a sulfoalkyl group, a carboxyalkyl group, a sulfoaralkyl group, or a carboxyaralkyl group; the alkyl moiety of each alkyl group contains up to 4 carbon atoms; $R_2$ represents a substituted or unsubstituted alkyl group or an aryl group; $R_3$ represents $-(CH_2)_{n1}CONH(CH_2)_{m1}OH$ or $-(CH_2)_{n2}O(CH_2)_{m2}OH$ (wherein $m_1$, $m_2$, $n_1$, and $n_2$ each is 1 to 7; $m_1+n_1$ and $m_2+n_2$ each is 8 or less); W represents a hydrogen atom, a halogen atom, a substituted or unsubstituted alkyl group, an alkoxy group or a substituted or unsubstituted phenyl group;

(II)

wherein Z represents a non-metallic atomic group necessary to complete a thiazolidine ring or a 4-thiazoline ring; $R_4$ and $R_5$ each represent a substituted or unsubstituted alkyl group, an allyl group, or a substituted or unsubstituted phenyl group; at least one of $R_4$ and $R_5$ being a sulfoalkyl group or a carboxyalkyl group; and $R_6$ represents a hydrogen atom, a substituted or unsubstituted alkyl group, or a substituted or unsubstituted phenyl group.

8 Claims, No Drawings

SILVER HALIDE PHOTOGRAPHIC MATERIALS

BACKGROUND OF THE INVENTION

1. Field of the Invention

This invention relates to silver halide photographic light-sensitive materials and, more particularly, to spectrally sensitized lith-type silver halide photographic light-sensitive materials (hereinafter referred to as "lith-type photographic materials").

2. Description of the Prior Art

A lith-type photographic material comprises a support having coated thereon a layer of a silver halide photographic emulsion having high contrast and is processed by a specific super high contrast developer (hereinafter referred to as "lithographic developer") to form an image composed of dots and lines having very high contrast, which is used as a photographic original for lithographic printing.

As a technique for producing silver halide photographic emulsions used for such lith-type photographic materials, it is well known to use a spectral sensitization method, that is a technique in which a certain sensitizing dye is added to a silver halide photographic emulsion to render the silver halide sensitive to light sources of long wavelengths.

On the one hand, a sensitizing dye can increase the spectral sensitivity of a lith-type silver halide photographic emulsion, but usually photographic materials containing sensitizing dyes are inferior in dot quality and hence it is very difficult to prepare photographic materials having sufficiently high sensitivity and contrast and provide excellent dot quality. It is already well known, for example, to use polyalkylene oxide compounds to provide excellent dot quality but the dot quality using a polyalkylene oxide compound is frequently liable to deteriorate due to the coexistence of sensitizing dyes.

From another particular nature of lithographic printing, it is advantageous to employ a red light as a safety light during processing. For this reason, it is particularly effective to increase green sensitivity of light sensitive materials. A representative techique for increasing green sensitivity is to use dimethine merocyanine type dyes in light sensitive materials.

Green-sensitized lith-type photographic materials containing dimethine merocyanine dyes, etc., are described in, for example, U.S. Pat. Nos. 4,144,070, 3,703,377 and 4,014,702, Japanese Pat. No. 41204/73, and *Research Disclosure,* Vol. 161, 16134 (published September 1977). However, the techniques disclosed in the literature are insufficient for obtaining a high green sensitivity and excellent dot quality simultaneously.

SUMMARY OF THE INVENTION

An object of this invention is to provide a silver halide photographic material having a high green sensitivity.

Other object of this invention is to provide a lith-type silver halide photographic material having high sensitive and high contrast photographic properties and providing excellent dot quality.

Still other object of this invention is to provide an image forming process providing excellent dot images by performing lithographic development using an automatic processor in high temperature processing.

It has been discovered that the above-described objects of this invention can be attained by the provision of a silver halide photographic light-sensitive material containing at least one of the sensitizing dyes represented by the following general formula (I) and at least one of the sensitizing dyes represented by the following general formula (II):

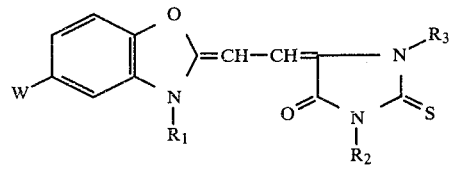

(I)

wherein $R_1$ represents a sulfoalkyl group, a carboxyalkyl group, a sulfoaralkyl group, or a carboxyaralkyl group; each of these groups having up to 4 carbon atoms; $R_2$ represents a substituted or unsubstituted alkyl or aryl group; $R_3$ represents $-(CH_2)_{n1}CONH(CH_2)_{m1}OH$ or $-(CH_2)_{n2}O(CH_2)_{m2}OH$ (wherein $m_1$, $m_2$, $n_1$ and $n_2$ each represents an integer of 1 to 7; however, $m_1+n_1$ and $m_2+n_2$ each is 8 or less than 8); and W represents a halogen atom, a substituted or unsubstituted alkyl group, an alkoxy group, or a substituted or unsubstituted phenyl group;

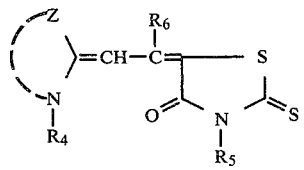

(II)

wherein Z represents a non-metallic atomic group necessary for completing a thiazolidine ring or a 4-thiazoline ring; $R_4$ and $R_5$ each represents a substituted or unsubstituted alkyl group, an allyl group, or a substituted or unsubstituted phenyl group; at least one of said $R_4$ and $R_5$ representing, however, a sulfoalkyl group or a carboxyalkyl group; and $R_6$ represents a hydrogen atom, a substituted or unsubstituted alkyl group, or a substituted or unsubstituted phenyl group.

DETAILED DESCRIPTION OF THE INVENTION

The sensitizing dyes of general formula (I) and general formula (II) used in this invention are described below in more detail.

$R_1$ in general formula (I) is a sulfoalkyl group the alkyl moiety of which contains up to 4 carbon atoms (e.g., 2-sulfoethyl group, 3-sulfopropyl group, 3-sulfobutyl group, 4-sulfobutyl group, 2-hydroxy-3-sulfopropyl group, 2-(3-sulfopropoxy)ethyl group, 2-acetoxy-3-sulfopropyl group, 3-methoxy-2-(3-sulfopropoxy)propyl group, 2-[2-(3-sulfopropoxy)ethoxy]ethyl group, 2-hydroxy-3-(3'-sulfopropoxy)propyl group, etc.), a carboxyalkyl group the alkyl moiety of which contains up to 4 carbon atoms (e.g., carboxymethyl group, 2-carboxyethyl group, 3-carboxypropyl group, 4-carboxybutyl group, 2-(2-carboxyethoxy)ethyl group, etc.), a sulfoaralkyl group the alkyl moiety of which contains up to 4 carbon atoms (e.g., p-sulfobenzyl group, p-sulfophenethyl group, etc.), or a carboxyaralkyl group the alkyl moiety of which contains up to 4 carbon atoms (e.g., p-carboxybenzyl group, etc.).

$R_2$ in the formula is a straight or branched alkyl group having up to 4 carbon atoms such as, for example, a methyl group, an ethyl group, a propyl group, a butyl group, etc.; a substituted alkyl group such as, for example, a hydroxyalkyl group (e.g., 2-hydroxyethyl group, 3-hydroxypropyl group, 4-hydroxybutyl group, etc.), an aralkyl group where the alkyl moiety being up to 4 carbon atoms (e.g., benzyl group, phenethyl group, phenylpropyl group, phenylbutyl group, p-tolylpropyl group, p-methoxyphenethyl group, p-chlorophenethyl group, etc.), a carbamoylalkyl group having up to 4 carbon atoms (e.g., carbamoylethyl group, etc.), and a cyanoalkyl group having up to 4 carbon atoms (e.g., cyanoethyl group, etc.); or an aryl group where the number of atoms for completing aromatic ring (or aryl) is 5 to 7 (such as, for example, phenyl group, p-methoxyphenyl group, 2-pyridyl group, 4-pyridyl group, etc.).

$R_3$ in the formula is $-(CH_2)_{n1}CONH(CH_2)_{m1}OH$ or $-(CH_2)_{n2}O(CH_2)_{m2}OH$ (wherein $m_1$, $m_2$, $n_1$ and $n_2$ each is an integer of 1 to 7; $m_1+n_1$ and $m_2+n_2$ each being, however, 8 or less.

W in the formula is a hydrogen atom, a halogen atom (e.g., a fluorine atom, a chlorine atom, a bromine atom, an iodine atom), a straight or branched alkyl group having up to 6 carbon atoms (e.g., methyl group, ethyl group, propyl group, butyl group, etc.), a substituted alkyl group (e.g., trichloromethyl group, trifluoromethyl group, etc.), a straight or branched alkoxy group having up to 6 carbon atoms (e.g., methoxy group, ethoxy group, etc.), or a substituted or unsubstituted phenyl group (e.g., p-methylphenyl group, p-chlorophenyl group, phenyl group, etc.).

Z in general formula (II) described above is a nonmetallic atomic group necessary to complete a thiazolidine ring or a 4-thiazoline group. Examples of the thiazolidine ring completed by Z are thiazolidine, etc., and examples of the 4-thiazoline ring are 4-thiazoline, 4-methyl-4-thiazoline, 4-phenyl-4-thiazoline, 4,5-dimethyl-4-thiazoline, 4,5-diphenyl-4-thiazoline, and the like.

$R_4$ and $R_5$ in the formula may be the same or different, each being an unsubstituted straight or branched alkyl group having up to 4 carbon atoms such as a methyl group, an ethyl group, an n-propyl group, an n-butyl group, etc.; a substituted alkyl group the alkyl moiety of which contains up to 5 carbon atoms such as a hydroxyalkyl group (e.g., 2-hydroxyethyl group, 3-hydroxypropyl group, 4-hydroxybutyl group, etc.), a carboxyalkyl group (e.g., carboxymethyl group, 2-carboxyethyl group, 3-carboxypropyl group, 4-carboxybutyl group, 2-(2-carboxyethoxy)ethyl group, etc.), a sulfoalkyl group (e.g., 2-sulfoethyl group, 3-sulfopropyl group, 3-sulfobutyl group, 4-sulfobutyl group, 2-hydroxy-3-sulfopropyl group, 3-methoxy-2-(3-sulfopropoxy)propyl group, 2-(3-sulfopropoxy)ethyl group, 2-acetoxy-3-sulfopropyl group, 2-[2-(3-sulfopropoxy)ethoxy]ethyl group, 2-hydroxy-3-(3'-sulfopropoxy)propyl group, etc.), an aralkyl group (e.g., a benzyl group, a phenethyl group, a phenylpropyl group, a phenylbutyl group, a p-tolylpropyl group, a p-methoxyphenyl group, a p-carboxybenzyl group, a p-sulfophenethyl group, a p-sulfobenzyl group, etc.), and an aryloxyalkyl group (e.g., phenoxyethyl group, phenoxypropyl group, phenoxybutyl group, p-methylphenoxyethyl group, etc.); an allyl group; or a substituted or unsubstituted phenyl group such as a phenyl group, an alkyl- or alkoxy-substituted phenyl group where the alkyl or alkoxy moiety has up to 4 carbon atoms (e.g., p- or m-methylphenyl, p- or m-ethylphenyl, p- or m-ethoxyphenyl, etc.), etc.; at least one of said $R_4$ and $R_5$ being a sulfoalkyl group or a carboxyalkyl group.

$R_6$ in the formula is a hydrogen atom; an unsubstituted straight or branched alkyl group having up to 4 carbon atoms such as a methyl group, an ethyl group, a propyl group, etc.; a substituted alkyl group such as a hydroxyethyl group, a hydroxypropyl group, a carboxyethyl group, an ethoxyethyl group, etc.; or an unsubstituted or substituted phenyl group such as a phenyl group, a 2-carboxyphenyl group, etc.

Practical examples of the sensitizing dyes used in this invention are illustrated below but the sensitizing dyes used in this invention are not limited to these alone.

Sensitizing dyes of the formula (I):

I-1

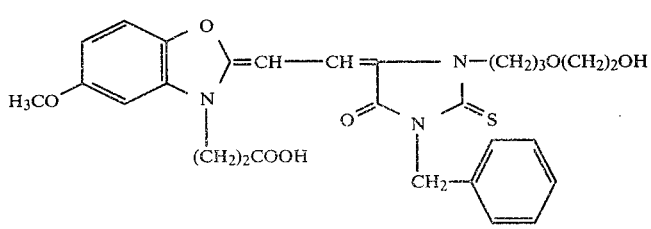

I-2

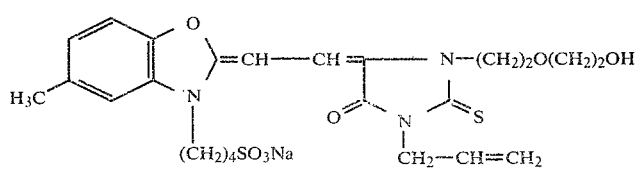

I-3

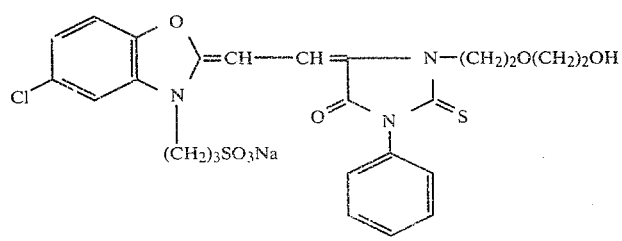

-continued
I-4
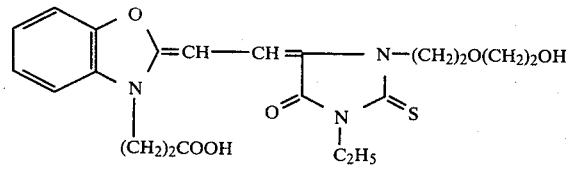
I-5
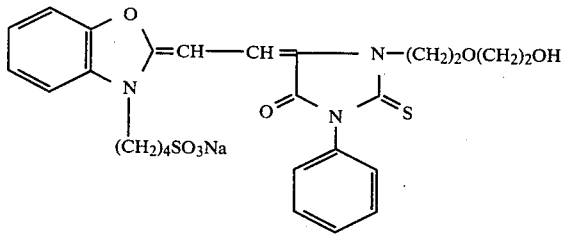
I-6
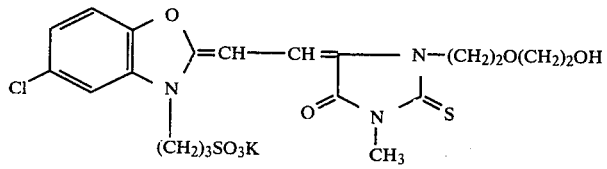
I-7
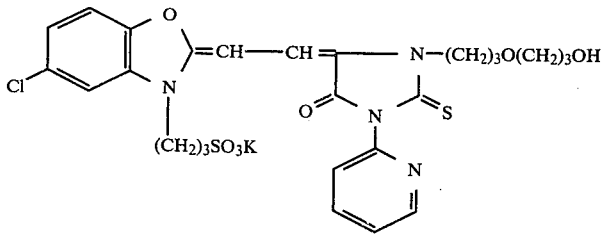
I-8
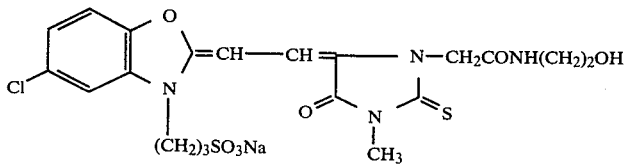
I-9
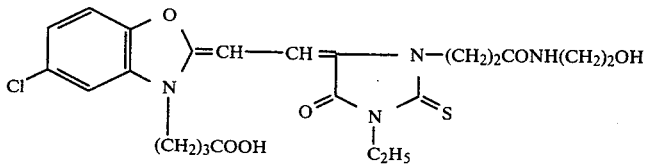
I-10
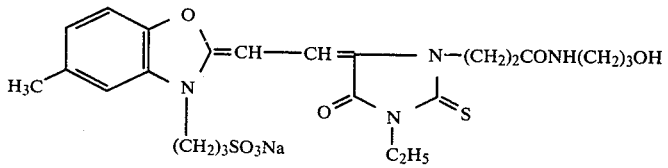
I-11
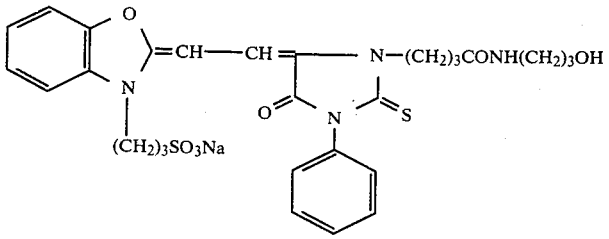

-continued
I-12
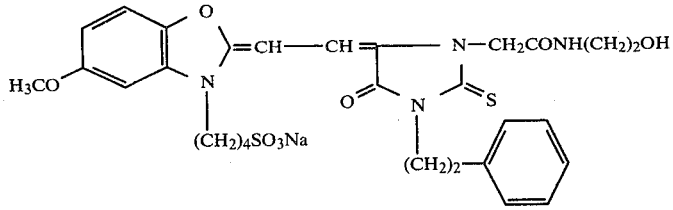
Sensitizing dyes of the formula (II):
II-1
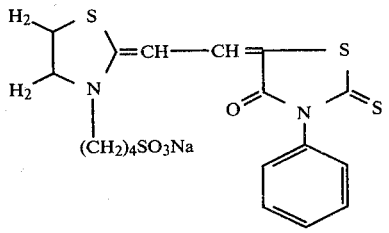
II-2
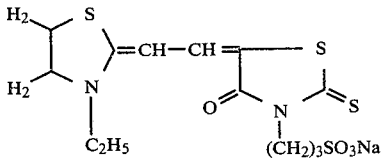
II-3
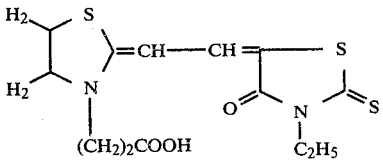
II-4
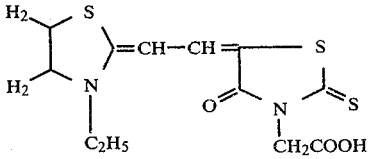
II-5
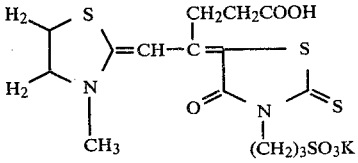
II-6
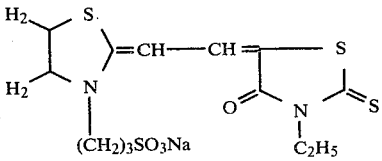
II-7
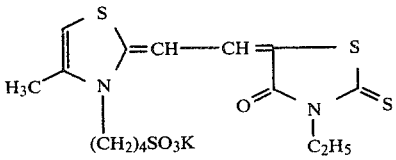
II-8
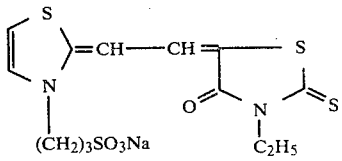

-continued

II-9

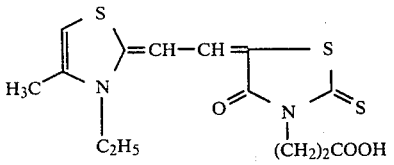

II-10

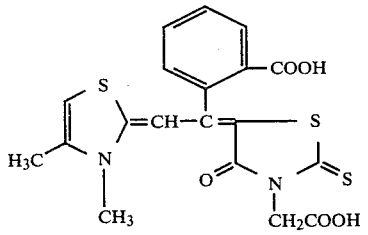

Preferred compounds used in this invention are those of formula (I) wherein $R_1$ is a sulfoalkyl group or a carboxyalkyl group and $m_1+n_1$ and $m_2+n_2$ each is an integer up to 6.

In one of the preferred embodiments of this invention, a lith-type silver halide photographic material containing a polyalkylene oxide compound (as defined later) contains at least one of the sensitizing dyes shown by the formula (I) and at least one of the sensitizing dyes shown by the formula (II).

In another embodiment of this invention, there is provided a lith-type silver halide photographic material containing at least one of the sensitizing dyes of formula (I), at least one of the sensitizing dyes of formula (II), and at least one of polyalkylene oxide compounds (as defined later), which is processed by a lithographic development using an automatic processor in high temperature processing to form dot images.

The sensitizing dyes of formula (I) and formula (II) described above are known compounds and may be easily prepared with reference to F. M. Hamer, *Cyanine Dyes and Related Compounds* (1964, Interscience Publishers).

Each of the sensitizing dyes of formula (I) and formula (II) is advantageously used at a concentration of from about $1\times10^{-5}$ mol to about $2\times10^{-3}$ mol per mol of the silver halide in a silver halide emulsion. Also, the mol ratio (I/II) of the sensitizing dye of formula (I) to the sensitizing dye of formula (II) is advantageously about 1/10 to 10/1, preferably about 1/5 to 5/1.

The sensitizing dyes of formulae (I) and (II) used in this invention can be directly dispersed in a silver halide emulsion. These sensitizing dyes may be first dissolved in a suitable solvent such as, for example, methanol, ethanol, methyl cellosolve, acetone, water, pyridine, etc., or a mixture of them and are added to a silver halide emulsion as the solution thereof. In the case of dissolution, ultrasonic waves can be used. Furthermore, the sensitizing dyes may be added to a silver halide emulsion by employing a method as described in U.S. Pat. No. 3,469,987 wherein the dyes are dissolved in a volatile organic solvent, the solution is dispersed in a hydrophilic colloid, and the dispersion is added to the silver halide emulsion; a method as described in Japanese Pat. No. 24185/71 wherein the insoluble dyes are dispersed in a water-soluble solvent without being dissolved in a solvent and the dispersion is added to a silver halide emulsion; a method as described in Japanese patent application (OPI) No. 75432/76 (the term "OPI" as used herein refers to a "published unexamined Japanese patent application") wherein the dyes are dissolved in a solution containing a surface active agent and the solution is added to a silver halide emulsion; or the methods described in U.S. Pat. Nos. 2,912,343, 3,342,605, 2,996,287, and 3,429,835. Also, the sensitizing dyes described above may be uniformly dispersed in a silver halide emulsion before the emulsion is coated on a support and in this case they may as a matter of course be dispersed in the silver halide emulsion in any step of preparating the silver halide emulsion.

The polyalkylene oxide compound used in this invention is a compound having at least partially a polyalkylene oxide structure capable of increasing the infectious developing effect of a silver halide photographic material. Such compounds are described in, for example, U.S. Pat. No. 2,400,532, 3,294,537 and 3,294,540, French Pat. Nos. 1,491,805 and 1,596,673, Japanese Pat. No. 23466/65, Japanese patent application (OPI) Nos. 156423/75, 108130/77 and 3217/78. Preferred examples of polyalkylene oxide compounds include the condensates of an alkylene oxide having 2 to 4 carbon atoms, such as ethylene oxide, propylene-1,2-oxide, butylene-1,2-oxide, etc., preferably a polyalkylene oxide comprising at least 10 units of ethylene oxide and a compound having at least one active hydrogen atom, such as water, an aliphatic alcohol, an aromatic alcohol, a fatty acid, an organic amine, and a hexitol derivative and also block copolymers of two or more polyalkylene oxides. Examples of the polyalkylene oxide compounds useful in this invention are as follows:

polyalkylene glycols,
polyalkylene glycol alkyl ethers,
polyalkylene glycol aryl ethers,
polyalkylene glycol alkylaryl ethers,
polyalkylene glycol esters,
polyalkylene glycol fatty acid amides,
polyalkylene glycol amines,
polyalkylene glycol block copolymers,
polyalkylene glycol graft copolymers, etc.

The polyalkylene oxides may contain not only one alkylene oxide chain but also two or more alkylene oxide chains in the molecule. In this case, each alkylene oxide chain may be composed of less than 10 alkylene oxide units but the sum of the alkylene oxide units in the molecule must be at least 10. When the polyalkylene oxide compound has two or more polyalkylene oxide chains in the molecule, each of the chains may be composed of different alkylene oxide unit such as, for example, ethylene oxide, propylene oxide, butylene oxide or styrene oxide. The polyalkylene oxide compound used in this invention preferably contains from 14 to 100 alkylene oxide units.

The polyalkylene oxide compounds used in this invention preferably have molecular weights of 300 to 15,000, preferably 600 to 8,000.

Practical examples of the polyalkylene oxide compounds used in this invention are illustrated below:

1. $HO(CH_2CH_2O)_{10}H$
2. $HO(CH_2CH_2O)_{90}H$
3. $C_4H_9O(CH_2CH_2O)_{15}H$
4. $C_{12}H_{25}O(CH_2CH_2O)_{15}H$
5. $C_{18}H_{37}O(CH_2CH_2O)_{15}H$
6. $C_{18}H_{37}O(CH_2CH_2O)_{40}H$
7. $C_8H_{17}CH{=}CHC_8H_{16}O(CH_2CH_2O)_{15}H$

8.

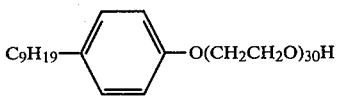

9.

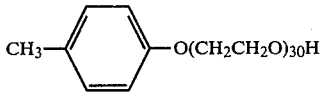

10.

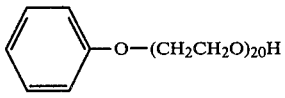

11. $C_{11}H_{23}COO(CH_2CH_2O)_{80}H$
12. $C_{11}H_{23}COO(CH_2CH_2O)_{24}OCC_{11}H_{23}$

13.

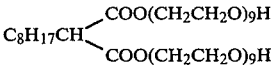

14. $C_{11}H_{23}CONH(CH_2CH_2O)_{15}H$

15.

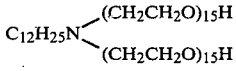

16. $C_{14}H_{29}N(CH_2)(CH_2CH_2O)_{24}H$

17.

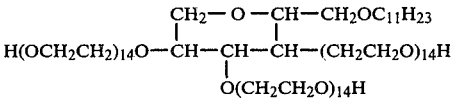

18.

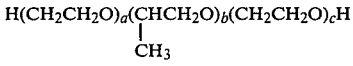

a + b + c = 50
b:a + c = 10:9

19.

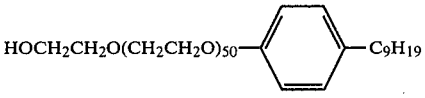

20.

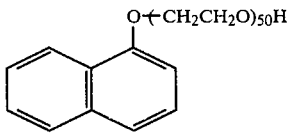

21. $HO(CH_2CH_2O)_a(CH_2CH_2CH_2CH_2O)_b(CH_2CH_2O)_cH$
a + c = 30, b = 14

-continued

22.

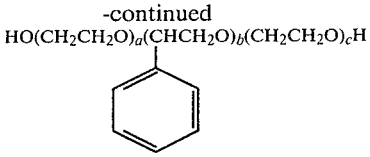

b = 8, a + c = 50

These polyalkylene oxide compounds may be used alone or as a mixture of two or more.

The polyalkylene oxide compounds may be added to silver halide emulsions in an ordinary manner. That is, the polyalkylene oxide compound is dissolved in water at a proper concentration or in a water-miscible organic solvent having, preferably, a low boiling point and at a proper step before coating or after, preferably, chemical ripening, the aqueous solution or the organic solvent solution is added to a silver halide emulsion. A portion of the polyalkylene oxide compound may be added to a non-light-sensitive hydrophilic colloid layer such as a protective layer without being added to a silver halide emulsion.

The polyalkylene oxide compound is added to a silver halide emulsion in an amount of from about $10^{-6}$ to about $10^{-1}$ mol per mol of silver, preferably $10^{-5}$ to $10^{-2}$ mol per mol of silver (though the polyalkylene oxide compound may also be added to a non-light-sensitive hydrophilic colloid layer, the amount is based on the mol of silver).

The lith-type photographic materials of this invention are generally developed using a so-called infectious developer for obtaining images having high edge gradient.

A lithographic developer (infectious developer) preferably used in this invention is fundamentally composed of o- or p-dihydroxybenzene, an alkalifying agent, a small amount of free sulfite, sulfite ion buffer, etc. The o- or p-dihydroxybenzene which is a developing agent for the developer may be properly selected from materials well known in the field of photography. Practical examples of the developing agent are hydroquinone, chlorohydroquinone, bromohydroquinone, isopropylhydroquinone, 2,3-dichlorohydroquinone, 2,5-dimethylhydroquinone, etc.

Among these materials, hydroquinone is particularly practical. These developing agents are used alone or as a mixture of them. The amount of the developing agent is 1 to 100 g, preferably 5 to 80 g, per liter of developer. The sulfite ion buffer is used in an amount effective for maintaining the concentration of a sulfite in the developer at almost a constant value. Examples of the buffer are an aldehyde-alkali hydrogensulfite addition product such as a formalin-sodium hydrogensulfite addition product, a ketone-alkali hydrogensulfite addition product such as acetone-sodium hydrogensulfite addition product, and a carbonyl hydrogensulfite-amine condensation product such as sodium bis(2-hydroxyethyl-)aminomethanesulfonate. The amount of the sulfite ion buffer is 13 to 130 g per liter of developer.

To the developer used in this invention may be added an alkali sulfite such as sodium sulfite for controlling the concentration of free sulfite ions. The amount of the sulfite is generally less than 5 g, preferably less than 3 g per liter of the developer although it may be larger than 5 g.

In many cases, it is preferred that the developer contain an alkali halide (in particular, a bromide such as sodium bromide and potassium bromide) as a development controlling agent. The amount of the alkali halide is 0.01 to 10 g, preferably 0.1 to 5 g, per liter of the developer.

An alkalifying agent is added to the developer for adjusting the pH of the developer above 9 (in particular to 9.7 to 11.5). As such an alkalifying agent, sodium carbonate or potassium carbonate is usually used and the amount of such an alkalifying agent is variously selected.

The lith-type photographic materials of this invention are very preferred since they are scarcely influenced by the ionic strength of the developer and the nature of the alkalifying agent and hence can provide almost constant and good photographic property even when they are processed by developers having different alkalifying agents and ionic strengths but better photographic property is obtained in case of processing the lith-type photographic materials by a developer having a low ionic strength.

The developer used in this invention may contain, if necessary, a pH buffer such as a watersoluble acid (e.g., acetic acid, boric acid, etc.), an alkali (e.g., sodium hydroxide), and a salt (e.g., sodium carbonate) in addition to the above-described components. A certain alkali not only render the developer alkaline but also act as a pH-buffer and a development controlling agent. The developer may also contain a preservative such as diethanolamine, ascorbic acid, kojic acid, etc., but the lithographic developer containing about 10 to 40 g/liter of diethanolamine is particularly preferred since the lith-type photographic materials processed by such a developer show a stabilized sensitivity and good dot quality. The developer may further contain other components, e.g., an anti-foggant such as benzotriazole, 1-phenyl-5-mercaptotetrazole, etc., and an organic solvent such as triethylene glycol, dimethylformamide, methanol, etc.

The developer used in this invention may contain the above-described components and hence the developer composition may be divided into two or more parts before use. For example, if the developer composition is divided into a portion containing a developing agent and a portion containing an alkali, they can be used immediately by only mixing the portions and diluting them upon use.

As a matter of course, good photographic properties are obtained by processing the lith-type photographic materials with a so-called powder type developer or a liquid-type developer.

The development temperature is preferably 20° to 40° C. although temperatures higher than these temperature ranges can be as a matter of course used but, in particular, preferred photographic properties can be obtained at development temperature higher than 24° C. The developing time depends upon the development temperature but is usually 10 to 250 seconds, particularly 10 to 150 seconds.

The development may be practiced by hand or using an automatic processor but preferred photographic properties can be obtained by using an automatic processor. In case of using an automatic processor, there is no particular restriction on the conveying means for the lith-type photographic materials (e.g., roller conveyer, belt conveyer, etc.) and a conveyer-type automatic processor used usually in the field of the art can be used in this invention. Other developer compositions and developing processes used in this invention are described in, for example, U.S. Pat. Nos. 3,025,779, 3,078,024, 3,122,086, 3,149,551, 3,156,173, 3,224,356, and 3,573,914.

The silver halide emulsions used in this invention can be prepared by a neutralization method, acid method, single jet method, double jet method, controlled double jet method, etc., as described in, for example, Mees, *The Theory of the Photographic Process,* 3rd Edition, pp. 31–43, published by Macmillan Co. in 1967 and Grafikides, *Chimie Photographique,* 2nd Edition, pp. 251 to 308, published by Paul Montel Co. in 1957.

A preferred silver halide composition is silver chlorobromide or silver chloroiodobromide (less than 5 mol% iodine) containing at least 60 mol% (preferably at least 75 mol%) silver chloride. There are no particular restrictions about the form of silver halide grains, the crystal habit, the grain size distribution, etc., but silver halide grains having grain sizes of less than 0.7 micron are preferred.

The sensitivity of the silver halide emulsions used in this invention can be increased without increasing the grain size of silver halide grains using a gold compound such as a chloroaurate, gold trichloride, etc.; a salt of a noble metal such as rhodium, iridium, etc.; a sulfur compound capable of forming silver sulfide by the reaction with a silver salt; or a reducing agent such as a stannous salt, an amine, etc.

As a vehicle for silver halides used in this invention, there are gelatin, denatured gelatin, gelatin derivatives, and synthetic hydrophilic polymers.

The silver halide emulsion layers or other layers of the lith-type photographic materials of this invention may contain a polymer latex comprising a homo- or copolymer such as alkyl acrylate, alkyl methacrylate, acrylic acid, glycidyl acrylate, etc., as described in U.S. Pat. Nos. 3,411,911, 3,411,912, 3,412,568, 3,325,286, and 3,547,650 and Japanese Pat. No. 5331/70 for improving the dimensional stability of the photographic materials and improving the properties of the photographic layers.

Silver halide photographic emulsions used in this invention may contain an anti-foggant such as 4-hydroxy-6-methyl-1,3,3a,7-tetrazaindene, 3-methylbenzothiazole, 1-phenyl-5-mercaptotetrazole, etc., as well as other anti-foggants well known in the field of arts as various heterocyclic compounds, mercury-containing compounds, mercapto compounds, and those described in Japanese patent application (OPI) Nos. 81024/74, 6306/75 and 19429/75 and U.S. Pat. No. 3,850,639.

The lith-type photographic materials of this invention may further contain such sensitizing dyes as simple merocyanine, dimethine merocyanine, monomethine cyanine, carbocyanine, rhodacyanine, etc., together with the sensitizing dyes shown by general formulae (I) and (II).

The lith-type photographic materials of this invention may contain inorganic or organic hardening agents. As such hardening agents, there are, for example, chromium salts (chromium alum, chromium acetate, etc.), aldehydes (formaldehyde, glyoxal, glutaraldehyde, etc.), N-methylol compounds (dimethylol urea, methylol dimethylhydantoin, etc.), dioxane derivatives (2,3-dihydroxydioxane, etc.), active vinyl compounds (1,3,5-triacryloylhexahydro-s-triazine, bis(vinylsulfonyl)-methyl ether, etc.), active halogen compounds (2,4-dichloro-6-hydroxys-triazine, etc.), mucohalogenoacids (mucochloric acid, mucophenoxychloric acid, etc.), isooxazoles, dialdehyde starch, 2-chloro-6-hydroxytriazinylated gelatin, etc. They can be used alone or as a combination of them. Practical examples of the hardening agents used in this invention are described in U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3.362,827, 3,539,644 and 3,543,292, British Pat. Nos. 676,628, 825,544, and 1,270,578, German Pat. Nos. 872,153 and 1,090,427 and Japanese Pat. Publ. Nos. 7133/59 and 1872/71.

The silver halide photographic emulsions used in this invention may further contain other surface active agents in addition to the polyalkylene oxide compounds described above in connection with this invention for improving the photographic materials and as coating aid.

As surface active agents preferably used in this invention, there are natural surface active agents such as saponin, etc.; nonionic surface active agents such as alkylene oxide series surface active agents (e.g., the surface active agents described in Japanese patent application (OPI) Nos. 156423/75 and 69124/74), glycidol series surface active agents, etc.; anionic surface active agents containing acid groups such as carboxylic acid, sulfonic acid (e.g., the surface active agents described in U.S. Pat. No. 3,415,649), phosphoric acid, a sulfuric acid ester group, a phosphoric acid ester group, etc.; and amphoteric surface active agents such as aminoacids, aminosulfonic acids, the sulfuric acid or phosphoric acid esters of aminoalcohol, etc.

In this invention, the compounds described in U.S. Pat. Nos. 3,288,612, 3,333,959, 3,345,175, 3,708,303, British Pat. No. 1,098,748, West German Pat. Nos. 1,141,531, and 1,183,784, Japanese patent application (OPI) Nos. 99031/74 and 65436/77, and Japanese patent application Nos. 31539/76 and 102266/76 can be used as a development accelerator.

Furthermore, other additives for silver halide emulsions and process of producing the photographic materials employed in this invention are described in *Product Licensing Index,* Vol. 92, 107–110 (1971).

The image exposure for forming photographic images can be practiced using any one of various known light sources such as tungsten lamp, fluorescent lamp, mercury lamp, xenon lamp, arc lamp, carbon arc lamp, xenon flash lamp, halogen lamp, luminous diode, cathode ray tube flying spot, a discharge lamp such as glow discharge tube, etc., a laser light such as argon laser, etc. The exposure time is usually from 1/1,000 sec. to 50 sec. but an exposure time shorter than 1/1,000 sec., for example, an exposure time of $1/10^4$ to $1/10^6$ sec. using a xenon flash lamp, a cathode ray tube, or a laser light as well as an exposure time longer than 50 sec. can be also employed in this invention. If necessary, the spectral composition of light used for the image exposure can be controlled using a color filter.

One of the features of this invention is that high contrast images can be obtained by using the silver halide photographic materials containing the abovedescribed novel combination of the sensitizing dyes.

Another feature of this invention is that excellent dot images are obtained by using the lith-type photographic materials containing the above-described two kinds of the sensitizing dyes and the polyalkylene oxide compound.

Still other feature of this invention is that excellent dot images having less stain (based on the sensitizing dyes) are obtained when the above-described lith-type photographic materials are processed by lithographic developer using an automatic processor.

EXAMPLE 1

A chemically sensitized silver halide emulsion containing 70 mol% silver chloride, 29.5 mol% silver bromide, and 0.5 mol% silver iodide was prepared. The mean grain size of the silver halide grains was 0.35 micron.

Then, 625 g each of the silver halide emulsion was placed in each of 21 pots and after adding thereto the sensitizing dye of general formula (I) and the sensitizing dye of general formula (II) as shown in Table 2 and further 4-hydroxy-6-methyl-1,3,3a,7-tetraazaindene (stabilizer) in an amount of 0.3 g per mol of silver halide, a polyalkylene oxide compound (Compound 22) in an amount of 0.70 g per mol of silver halide, sodium dodecylbenzenesulfonate (surface active agent) in an amount of 2 g per mol of silver halide, mucochloric acid (hardening agent) in an amount of 0.8 g per mol of silver halide, and then the polymer latex described in Formulation Example 5 of Japanese Patent Publication No. 5331/70 in an amount of 40 g per mol of silver halide, and resultant mixture was coated on a polyethylene terephthalate film to provide each photographic material.

Each of these samples was brought into close contact with a negative gray contact screen (150 L/inch, made by Dainippon Screen Mfg. Co., Ltd.) and exposed to a white tungsten light (2,860° K.) for 5 seconds through a step wedge having a step different of 0.1 (log E).

After exposure, the samples were developed for 100 seconds at 27° C. by means of an automatic processor using the lithographic developer shown in Table 1. Since the developing time for obtaining the best dot quality in Samples 1 to 21 differed within few seconds only, the dot quality of the samples were evaluated on those processed for 100 seconds. The relative sensitivity was evaluated as the reciprocal of the exposure amount for forming a 50% blackened area (the relative sensitivity of Sample No. 1 was defined to be 100) and the dot quality was evaluated in five grades of A (excellent) to E (poor) by observing dots on blackened areas of 10, 50 and 90% with a magnifying lens of 100 magnifications. Also, the state of the formation of stains at the unexposed areas of each sample after development was evaluated by five grades of A (excellent) to E (poor). The results are shown in Table 2.

As shown in the table, the dot quality of Comparison Samples No. 1, No. 4, No. 7, and No. 10 was greatly inferior as compared to Sample Nos. 2, 3, 5, 6, 8, 9, 11, and 12 of this invention containing both the sensitizing dyes of general formulae (I) and (II). Also, Comparison Samples No. 13 to No. 17 using the sensitizing dye of general formula (I) only showed very low sensitivity as compared with Samples Nos. 2, 3, 5, 6, 8, 9, 11 and 12 of this invention. Furthermore, Comparison Samples No. 18 to No. 21 using sensitizing dye A other than the sensitizing dyes of this invention showed greatly large formation of stains.

TABLE 1

| (Developer) | |
|---|---|
| Hydroquinone | 15 g |
| Addition product of formaldehyde and sodium bisulfite | 50 g |
| Potassium carbonate | 30 g |
| Sodium sulfite | 2.5 g |
| Potassium bromide | 2.0 g |
| Boric acid | 5.0 g |
| Sodium hydroxide | 3.0 g |

TABLE 1-continued

| (Developer) | |
|---|---|
| Triethylene glycol | 40 g |
| Ethylenediaminetetraacetic acid . 2-sodium salt | 1.0 g |
| Diethanolamine | 15 g |
| Water to make | 1,000 ml |

Sensitizing Dye A:

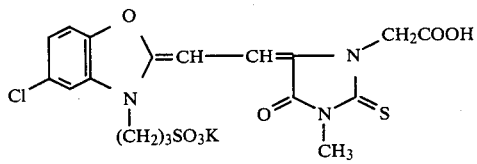

TABLE 3-continued

| No. | Relative Sensitivity | Dot Quality | Note |
|---|---|---|---|
| 11 | 97 | B | This Invention |
| 12 | 100 | " | " |
| 13 | 72 | C | Comparison |
| 14 | 72 | " | " |
| 15 | 65 | " | " |
| 16 | 76 | " | " |
| 17 | 67 | " | " |
| 18 | 82 | D | " |
| 19 | 83 | B | " |
| 20 | 83 | " | " |
| 21 | 82 | " | " |

TABLE 2

| No. | Sensitizing Dye (I) Kind | Sensitizing Dye (I) Amount* | Sensitizing Dye (II) Kind | Sensitizing Dye (II) Amount* | Relative Sensitivity | Dot Quality | Stain | Note |
|---|---|---|---|---|---|---|---|---|
| 1 | I-6 | $3.0 \times 10^{-4}$ | — | — | 100 | E | B | Comparison |
| 2 | " | " | II-4 | $2.0 \times 10^{-4}$ | 103 | A | " | This Invention |
| 3 | " | " | II-3 | " | 104 | A | " | " |
| 4 | I-5 | " | — | — | 96 | E | " | Comparison |
| 5 | " | " | II-4 | $2.0 \times 10^{-4}$ | 97 | A | " | This Invention |
| 6 | " | " | II-3 | " | 99 | A | " | " |
| 7 | I-3 | " | — | — | 102 | E | " | Comparison |
| 8 | " | " | II-4 | $2.0 \times 10^{-4}$ | 103 | A | " | This Invention |
| 9 | " | " | II-3 | " | 105 | A | " | " |
| 10 | I-4 | " | — | — | 97 | E | " | Comparison |
| 11 | " | " | II-4 | $2.0 \times 10^{-4}$ | 99 | A | " | This Invention |
| 12 | " | " | II-9 | " | 102 | A | " | " |
| 13 | — | — | II-4 | $2.0 \times 10^{-4}$ | 70 | C | " | Comparison |
| 14 | — | — | " | $3.0 \times 10^{-4}$ | 70 | " | " | " |
| 15 | — | — | " | $4.0 \times 10^{-4}$ | 60 | " | " | " |
| 16 | — | — | II-3 | $2.0 \times 10^{-4}$ | 75 | " | " | " |
| 17 | — | — | II-9 | " | 65 | " | " | " |
| 18 | A | $3.0 \times 10^{-4}$ | — | — | 80 | E | E | " |
| 19 | " | " | II-4 | $2.0 \times 10^{-4}$ | 82 | B | " | " |
| 20 | " | " | II-3 | " | 83 | " | " | " |
| 21 | " | " | II-9 | " | 79 | " | " | " |

*The amount per mol of silver halide.

EXAMPLE 2

Photographic materials were prepared in the same manner as in Example 1 and exposed by the same method as the example. After exposure, each sample was developed in a dish for 3 minutes at 20° C. using the lithographic developer having the same composition as shown in Table 1.

The relative sensitivity and dot quality were evaluated on each sample and the results are shown in Table 3.

As shown in the table, Comparison Samples No. 1, No. 4, No. 7 and No. 10 showed greatly poor dot quality as compared with Samples Nos. 2, 3, 5, 6, 8, 9, 11 and 12 of this invention and Comparison Samples No. 13 to No. 17 showed very low sensitivity as compared with the samples of this invention.

TABLE 3

| No. | Relative Sensitivity | Dot Quality | Note |
|---|---|---|---|
| 1 | 100 | D | Comparison |
| 2 | 102 | B | This Invention |
| 3 | 104 | " | " |
| 4 | 95 | D | Comparison |
| 5 | 98 | B | This Invention |
| 6 | 100 | " | " |
| 7 | 101 | D | Comparison |
| 8 | 105 | B | This Invention |
| 9 | 105 | " | " |
| 10 | 95 | D | Comparison |

EXAMPLE 3

To silver halide emulsions prepared in the same manner as Example 1 without using the polyalkylene oxide compound was added the polyalkylene oxide compound shown in Table 4 and after adding thereto $3.0 \times 10^{-4}$ mol of the sensitizing dye I-8 and $2.0 \times 10^{-4}$ mol of the sensitizing dye II-4 per mol of silver halide, the resultant mixture was coated on a polyethylene terephthalate film to provide photographic materials. Each of the samples was exposed and developed by the manners as described in Example 1.

The relative sensitivity (that of Sample 22 was defined to be 100) and the dot quality of the samples were evaluated and the results are shown in Table 4.

TABLE 4

| No. | Polyalkylene Oxide Compound: Compound No. | Polyalkylene Oxide Compound: Amount* (g) | Result: Relative Sensitivity | Result: Dot Quality |
|---|---|---|---|---|
| 22 | 8 | 0.8 | 100 | A |
| 23 | 9 | 0.7 | 102 | " |
| 24 | 14 | 0.6 | 101 | " |
| 25 | 15 | 0.5 | 100 | " |
| 26 | 18 | 0.3 | 98 | " |
| 27 | 19 | 0.5 | 99 | " |
| 28 | 20 | 0.5 | 100 | " |
| 29 | 21 | 0.4 | 103 | " |

*per mol of silver halide

EXAMPLE 4

A chemically sensitized silver chlorobromide emulsion containing 80 mol% silver chloride and 20% silver bromide was prepared. The mean grain size of the silver halide grains in the emulsion was 0.40 micron. To the silver halide emulsion were added the sensitizing dyes as shown in Table 5 and after further adding thereto the stabilizer, surface active agent, hardening agent, and polymer latex as in Example 1, the resultant emulsion was coated on a film base. The photographic materials thus prepared were exposed and developed as in Example 1. The results are shown in Table 5.

As shown in the table, the samples of this invention were superior to the comparison samples on the dot quality and the formation of stain.

TABLE 5

| No. | Sensitizing Dye (I) Kind | Sensitizing Dye (I) Amount *1 (mol) | Sensitizing Dye (II) Kind | Sensitizing Dye (II) Amount *1 (mol) | Other Dye (mol) | Relative Sensitivity | Dot Quality | Stain | Note |
|---|---|---|---|---|---|---|---|---|---|
| 30 | I-1 | $3 \times 10^{-4}$ | II-6 | $2 \times 10^{-4}$ | — | 102 | A | B | This Invention |
| 31 | I-5 | " | II-6 | " | — | 110 | A | B | " |
| 32 | I-11 | " | II-6 | " | — | 105 | A | B | " |
| 33 | B | " | II-6 | " | C $1 \times 10^{-4}$ | 100 | C | C | Comparison *2 |
| 34 | " | " | II-6 | " | — | 95 | C | C | Comparison *3 |

*1: The amount per liter of silver halide.
*2: The combination disclosed in Research Disclosure, Vol. 161, 16134 (published September 1977).
*3: The combination of sensitizing dyes analogized by the above Research Disclosure.

Sensitizing Dye B: (the dye same as dye (2) of Group III in *Research Disclosure* described above and having the following structure)

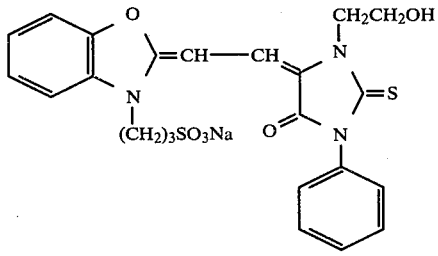

Sensitizing Dye C: (the dye same as dye (3) of Group II in *Research Disclosure* described above and having the following structure)

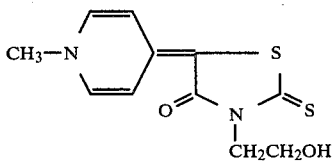

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having coated thereon a silver halide emulsion layer containing at least one sensitizing dye represented by the following formula (I) and at least one sensitizing dye represented by the following formula (II):

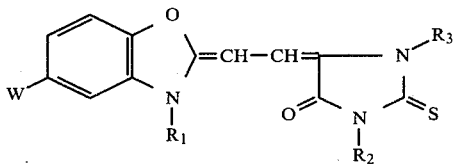

(I)

wherein $R_1$ represents a sulfoalkyl group, a carboxyalkyl group, a sulfoaralkyl group, or a carboxyaralkyl group; the alkyl moiety of said groups having up to 4 carbon atoms; $R_2$ represents a substituted or unsubstituted alkyl group or an aryl group; $R_3$ represents $-(CH_2)_{n_1}CONH(CH_2)_{m_1}OH$ or $-(CH_2)_{n_2}O(CH_2)_{m_2}OH$, wherein $m_1$, $m_2$, $n_1$, and $n_2$ each represents an integer of 1 to 7, $m_1+n_1$ and $m_2+n_2$ being, however, 8 or less and W represents a hydrogen atom, a halogen atom, a substituted or unsubstituted alkyl group, an alkoxy group, or a substituted or unsubstituted phenyl group;

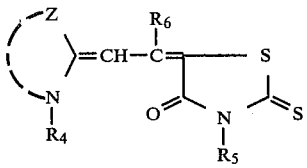

(II)

wherein Z represents a non-metallic atomic group necessary for completing a thiazolidine ring or a 4-thiazoline ring; $R_4$ and $R_5$ each represents a substituted or unsubstituted alkyl group, an allyl group, or a substituted or unsubstituted phenyl group; at least one of said $R_4$ and $R_5$ being a sulfoalkyl group or a carboxyalkyl group; and $R_6$ represents a hydrogen atom, a substituted or unsubstituted alkyl group or a substituted or unsubstituted phenyl group.

2. The silver halide photographic material of claim 1, wherein the amount of each of the sensitizing dyes represented by general formulae (I) and (II) is from about $1 \times 10^{-5}$ mol to $2 \times 10^{-3}$ mol per mol of the silver halide in the silver halide emulsion.

3. The silver halide photographic material of claim 1, wherein the ratio of the sensitizing dye shown by general formula (I) to the sensitizing dye shown by general formula (II) is from 1/10 to 10/1.

4. The silver halide photographic material of claim 1, wherein said silver halide emulsion further contains a polyalkylene oxide compound.

5. The silver halide photographic material of claim 4, wherein said alkylene oxide compound has a molecular weight of about 300 to 15,000.

6. The silver halide photographic material of claim 1, wherein said silver halide photographic material is a lith-type material.

7. A process for forming a high contrast image composed of dots and lines which comprises image-wise exposing a silver halide photographic material comprising a support having coated thereon a silver halide emulsion layer containing at least one sensitizing dye represented by the following formula (I) and at least one sensitizing dye represented by the following formula (II):

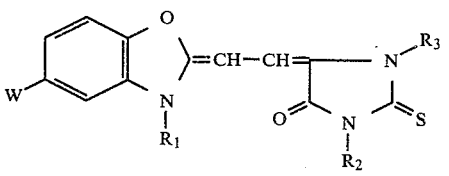

(I)

wherein $R_1$ represents a sulfoalkyl group, a carboxyalkyl group, a sulfoaralkyl group, or a carboxyaralkyl group; the alkyl moiety of said groups having up to 4 carbon atoms; $R_2$ represents a substituted or unsubstituted alkyl group or an aryl group; $R_3$ represents $-(CH_2)_{n1}CONH(CH_2)m_1OH$ or $-(CH_2)_{n2}O(CH_2)m_2OH$, wherein $m_1$, $m_2$, $n_1$, and $n_2$ each represents an integer of 1 to 7, $m_1+n_1$ and $m_2+n_2$ being, however, 8 or less; and W represents a hydrogen atom, a halogen atom, a substituted or unsubstituted alkyl group, an alkoxy group, or a substituted or unsubstituted phenyl group;

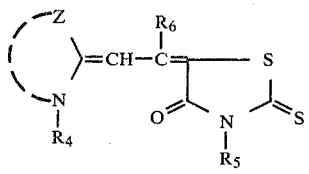

(II)

wherein Z represents a non-metallic atomic group necessary for completing a thiazolidine ring or a 4-thiazoline ring; $R_4$ and $R_5$ each represents a substituted or unsubstituted alkyl group, an allyl group, or a substituted or unsubstituted phenyl group; at least one of said $R_4$ and $R_5$ being a sulfoalkyl group or a carboxylic group; and $R_6$ represents a hydrogen atom, a substituted or unsubstituted alkyl group or a substituted or unsubstituted phenyl group and developing said image-wise exposed silver halide photographic material with an infectious developer.

8. The process of claim 7, wherein said infectious developer comprises an o- or p-dihydroxybenzene compound, an alkaline agent, free sulfite ion and a sulfite ion buffer.

* * * * *